US009169695B1

(12) United States Patent
Calvert

(10) Patent No.: US 9,169,695 B1
(45) Date of Patent: Oct. 27, 2015

(54) OIL EXPLORATION PROBE

(71) Applicant: OEP Associates, Trustee for Oil exploration probe CRT Trust, Manassas, VA (US)

(72) Inventor: S. Mill Calvert, Manassas, VA (US)

(73) Assignee: OEP Associates, Trustee for Oil exploration probe CRT Trust, Manassas, VA (US)

( * ) Notice: Subject to any disclaimer, the term of this patent is extended or adjusted under 35 U.S.C. 154(b) by 0 days.

(21) Appl. No.: 14/693,466

(22) Filed: Apr. 22, 2015

(51) Int. Cl.
*E21B 7/00* (2006.01)
*E21B 43/116* (2006.01)

(52) U.S. Cl.
CPC ..... *E21B 7/007* (2013.01); *E21B 43/116* (2013.01)

(58) Field of Classification Search
CPC ..... E21B 43/116; E21B 43/117; E21B 7/007
See application file for complete search history.

(56) References Cited

U.S. PATENT DOCUMENTS

| | | | | | |
|---|---|---|---|---|---|
| 87,372 | A * | 3/1869 | Shaffner | 102/320 |
| 2,921,519 | A * | 1/1960 | Martin | 102/317 |
| 2,936,708 | A * | 5/1960 | Borins et al. | 102/307 |
| 3,070,010 | A * | 12/1962 | Robinson, Jr. | 175/4.5 |
| 3,216,320 | A * | 11/1965 | Thomas et al. | 175/3.5 |
| 3,590,738 | A * | 7/1971 | Holzman | 102/313 |
| 3,917,007 | A * | 11/1975 | Tsiferov | 175/14 |
| 3,934,659 | A * | 1/1976 | Tsiferov | 175/14 |
| 4,030,557 | A * | 6/1977 | Alvis et al. | 175/4.5 |
| 5,479,860 | A | 1/1996 | Ellis | |
| 6,233,851 | B1 * | 5/2001 | Alexander et al. | 37/195 |
| 6,666,141 | B2 * | 12/2003 | Hagerty | 102/282 |
| 6,837,310 | B2 * | 1/2005 | Martin | 166/297 |
| 7,044,225 | B2 | 5/2006 | Haney et al. | |
| 7,258,054 | B1 | 8/2007 | Keeling et al. | |
| 7,896,104 | B2 * | 3/2011 | Becker et al. | 175/3.5 |
| 8,074,737 | B2 * | 12/2011 | Hill et al. | 175/4.55 |
| 8,167,044 | B2 | 5/2012 | Huang et al. | |
| 8,584,772 | B2 | 11/2013 | Yang et al. | |
| 2009/0050322 | A1 * | 2/2009 | Hill et al. | 166/297 |
| 2010/0032206 | A1 * | 2/2010 | Becker et al. | 175/4.5 |

FOREIGN PATENT DOCUMENTS

FR 536953 A * 5/1922

* cited by examiner

*Primary Examiner* — Jennifer H Gay
(74) *Attorney, Agent, or Firm* — Louis Ventre, Jr.

(57) ABSTRACT

An exploratory shaft-making apparatus creates a vertical hole down into a geological formation while sending a payload into the vertical hole. The apparatus includes a metallic cylindrical casing; a hollow, conical head section; a payload body; and shaped charges of high explosive below the payload body. The shaped charges are adapted to sequentially detonate starting with the bottom-most shaped charge. The detonation of each shaped charge is configured to create a void space in the geological formation below the casing. The void space permits gravity to move the remaining shaped charges and the payload body atop them to slide downward so that the next shaped charge to detonate is positioned below the bottom end of the metallic cylindrical casing. A shock absorbing material may be included in the head section. The payload body optionally has a removable cap. A lift fitting may be attached to the payload body.

6 Claims, 4 Drawing Sheets

OIL EXPLORATION PROBE

TECHNICAL FIELD

In the field of boring or penetrating a geological formation, a means is disclosed for initially forming and radially enlarging an elongated hole in the geological formation in situ by dislocating the solid material of the geological formation.

BACKGROUND ART

A primary and important source of energy in the world today is oil. It is the backbone of our economy. It heats our homes, and propels our cars, trucks, ships, airplanes, and makes sure we have a job to work at. Because oil is so valuable, it represents great wealth and that is why it is referred to as black gold.

Near-surface petroleum deposits are well known phenomena mostly observed by petroleum exuding or seeping from the ground. Petroleum seeps are common in many areas of the world. The occurrence of surface petroleum was often memorialized in location names associated with early oil and gas exploitation as well as scientific and technological developments. As early as 1753, the surface oil springs of Pennsylvania were identified. While today's oil wells can be miles deep, there is still opportunity to develop petroleum from near surface deposits, provided that they can be discovered.

There are still countless undiscovered large and small pools of oil reserves that lay below the surface we walk on. The problem with trying to discover new oil is that it is very expensive to have all the heavy drilling equipment transported and set up at a site to try and drill a test hole. Many times the uneven topography of the terrain makes it almost impossible to get this drilling equipment to the site. Even if you do have vast amounts of money to spend on drilling a test hole, the chances of finding oil are very low.

America is a large country from sea to shining sea. If one flies across the country in an airplane, it is plain to see that most of the country is undeveloped small parcels of rural and farm land. People refer to this as "Fly Over Country." There are still vast oil reserves waiting to be discovered on this rural and farm property. Most of the owners of these small farm parcels are just typical families that have very little money to spend. They are unlikely to ever have enough money for a professional drilling company to come to their property and set up all the equipment to drill a test well hole. They may be just making ends meet on a limited fixed income and they may be walking over top of a fortune in oil that lies below their feet. Such people are often referred to as "land rich and cash poor," because they have a small family farm that has been passed down for generations, and they may live close to or below the poverty line.

Near-surface water aquifers are also highly sought by farmers needing water for crops. Water wells have a very long history for human activity. One of the world's oldest known water wells is located in Cyprus, dated to 7000-8500 BC. Until recent time, all artificial wells were pumpless, hand-dug wells of varying degrees of formality, and they remain a very important source of potable water in some rural developing areas where they are routinely dug and used today. Such wells have been successfully excavated to about 60 meters (200 ft).

SUMMARY OF INVENTION

An exploratory shaft-making apparatus creates a vertical hole down into a geological formation while sending a payload into the vertical hole. The apparatus includes a metallic cylindrical casing; a hollow, conical head section or drive point attached at the bottom of the casing, a payload body shaped to slide downward and out of the casing, and shaped charges of high explosive below the payload body also configured to slide downward and then out of the casing. The shaped charges are adapted to sequentially detonate starting with the bottom-most shaped charge. The detonation of each shaped charge is configured to create a void space in the geological formation below the casing. The void space permits gravity to move the remaining shaped charges and the payload body above to slide downward so that the next shaped charge to detonate is positioned below the bottom end of the metallic cylindrical casing. A shock absorbing material may be included in the head section to cushion the bottom most shaped charge therewithin. The payload body optionally has a removable cap. A lift fitting may be attached to the payload body so that it can be lifted from the ending hole once it has finished its testing function. The shaped charges may be placed in a housing that snaps to an upper or lower housing for stacking purposes and to aid in directing the detonations. The payload body may include an instrument, a central processing unit to control the instrument and detonations, computer memory for storing program instructions and data received from the instrument, and a radio-frequency transmitter adapted to send the data to the surface.

Technical Problem

There is a need for a means for farmers or families that own small land parcels to quickly and inexpensively drill a test hole on their property to look for oil, potable water or other minerals.

Human activity to dig a well can be labor intensive and often can result in dry wells, which are discouraging and costly for the farmer. Water wells can vary greatly in depth, water volume, and water quality. Well water typically contains more minerals in solution than surface water and may require treatment to soften the water.

Solution to Problem

The answer is a relatively inexpensive hole-making and geological testing apparatus termed the oil exploration probe. This new technology gives the farmer an easy method to send an oil test sensor into the ground as far as needed to test for the presence of water, undiscovered oil or other minerals. For example, with this technology, the farmer can now inexpensively test several different sites on his farm for possible oil.

The oil exploration probe is a solution that works by having a cylindrical shaped payload capsule that has oil test equipment sensors lowered into the ground to test for any possible oil, or other resource. A test sensor payload is incrementally lowered into the ground having a similar path as if it were driven into the ground by a pile driver. But unlike a regular pile driver that hammers a pole into the ground, the oil exploration probe system has no downward hammer pressure on the top of the unit to drive it downward. It instead relies on a series of layered small shaped charges to compress the soil away from explosion so that gravity can continue to drop the payload test capsule lower into the ground.

The shaped charge modules preferably snap together forming a stack. A metal casing holds the test sensor payload capsule with the shaped charges stacked below. The farmer can grab a box of the shaped charge modules and snap on a number of them to reach the desired test depth. If he wants to go down 30 feet, he will select a number of modules, and if he wants to go down 60 feet, he will probably double the number of modules.

Advantageous Effects of Invention

The oil exploration probe can be made in different versions from a basic inexpensive model to a more expensive technically advanced model. The cheapest model may have no RF transmitter and may only have chemical oil sensor strips so the farmer has to pull the payload unit out of the hole with the rope to look and see if the chemical test strips changed color to indicate oil.

The oil exploration probe is an innovative and beneficial new technology so that a test payload capsule can be lowered into the ground inexpensively. This invention will help many small farmers and landowners that are poor to now become wealthy and grab hold of that American Dream. New discoveries of small pools of oil throughout the country will strengthen and boost our American economy and our security in the world.

A mid priced version may have the small battery RF transmitter and an oil test instrument in the payload capsule. There could be a very expensive oil exploration probe version that has a computer controller that controls all functions of the device. With the computer you could select depth; the computer would measure the depth; it would individually control each shaped charge and their timing; when it reaches the desired depth it would not fire any more shaped charges; it can activate different payload test functions at different depths; it can have payload carry a whole variety of other equipment to perform other functions like testing for natural gas, coal, or other material; it could have a data teetered line back to a computer or controller on the surface; etc.

The oil exploration probe offers many farmers and families a tool to be lifted out of poverty and to grasp their piece of the American Dream. Numerous new discoveries of oil all across our country would be a gigantic boom to the strength and security of our country and the national economy.

BRIEF DESCRIPTION OF DRAWINGS

The drawings illustrate preferred embodiments of the oil exploration probe according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made without departing from the scope of the present invention.

Figure 1:
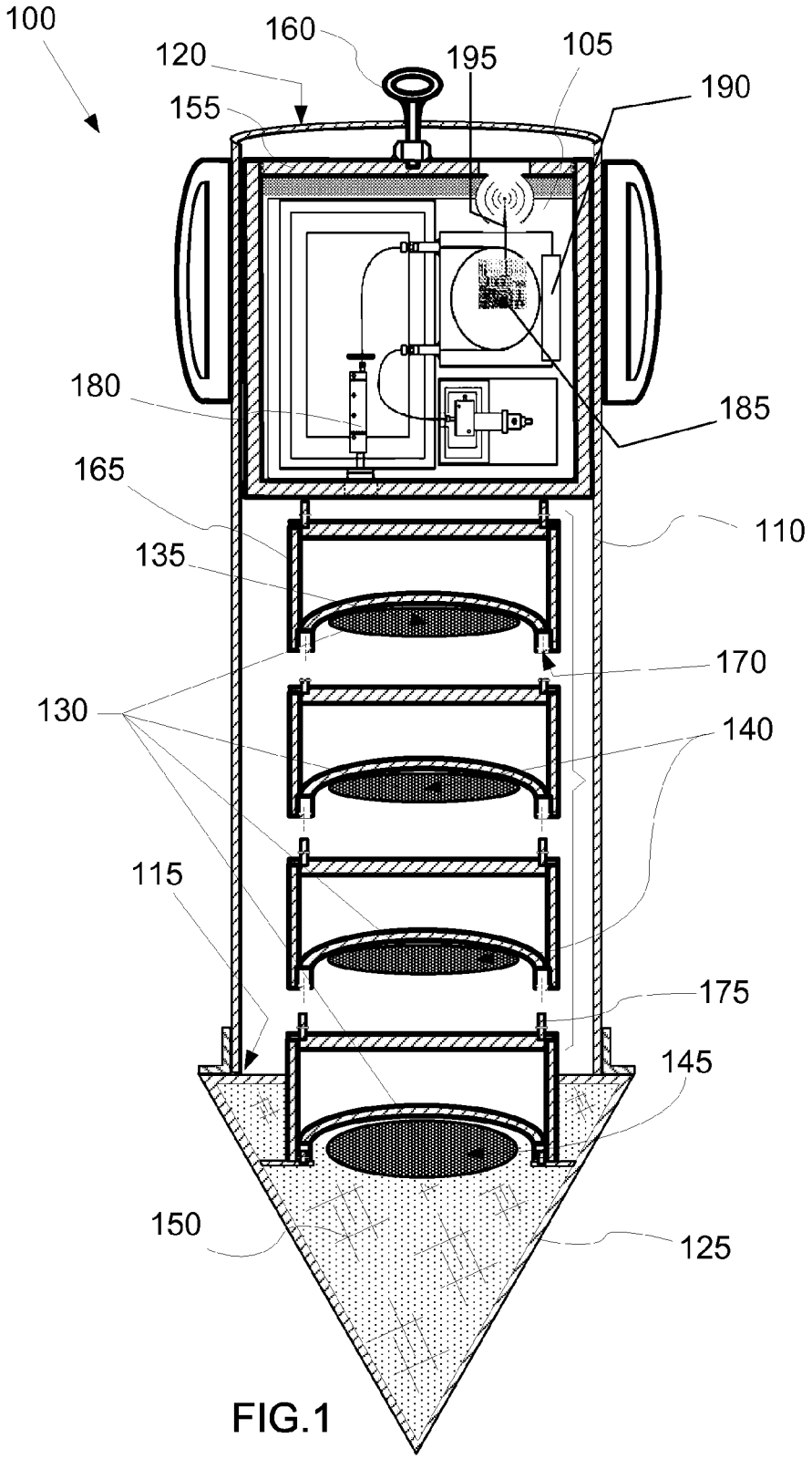
FIG. 1 is a sectional elevation view of a preferred embodiment of an exploratory shaft-making apparatus incorporating an exploded view of housings holding a plurality of shaped charges.

An exploratory shaft-making apparatus (100) is shown as a preferred embodiment in FIG. 1. The exploratory shaft-making apparatus (100) is adapted to create a vertical hole (210) down into a geological formation (205) while sending a payload (105) into the vertical hole (210), preferably by action of gravity.

The exploratory shaft-making apparatus (100) includes a metallic cylindrical casing (110); a head section (125); a payload body (305); and a plurality of shaped charges (130).

The metallic cylindrical casing (110) is essentially a tube with a bottom end (115) and a top end (120). The bottom end (115) is the end that enters the geological formation first. The top end (120) is at the opposite end, closer to the surface. In preferred embodiments, the metallic cylindrical casing (110) is made of steel or other heavy metal so that it is a sturdy container that will remain unchanged after being thrust into the geologic formation (205) for the initial operating position. For example, if the metallic cylindrical casing (110) is dropped from a tripod or other higher-elevation device using aerial rigging (505), the metallic cylindrical casing (110) will first enter the ground with some force and thereafter the plurality of shaped charges (130) will be sequentially detonated to form the vertical hole (210). In another example, handles (510) are used by a crew of men either with or without aid from a tractor or other vehicle to place the exploratory shaft-making apparatus (100) in its initial position.

Figure 3:
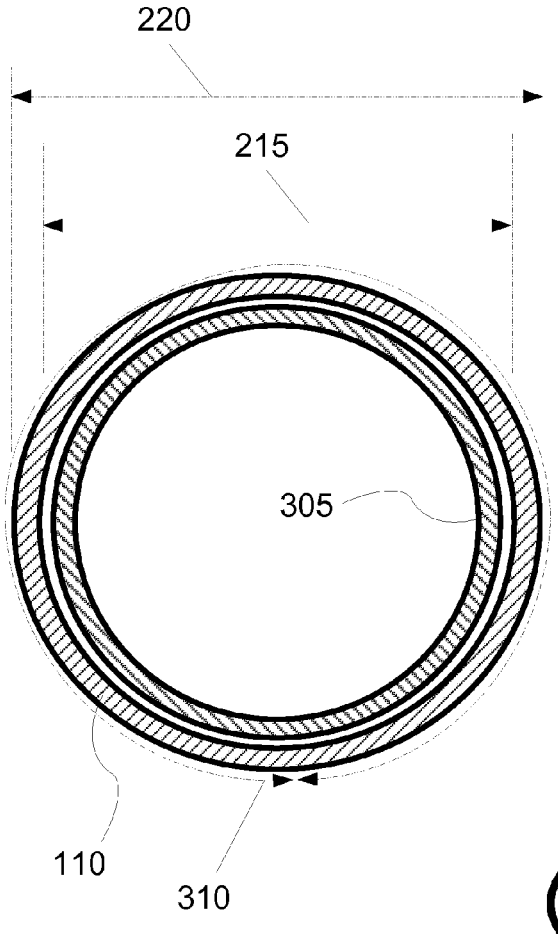
FIG. 3 is a top sectional view showing the metallic cylindrical casing and the payload body within.
Figure 4:
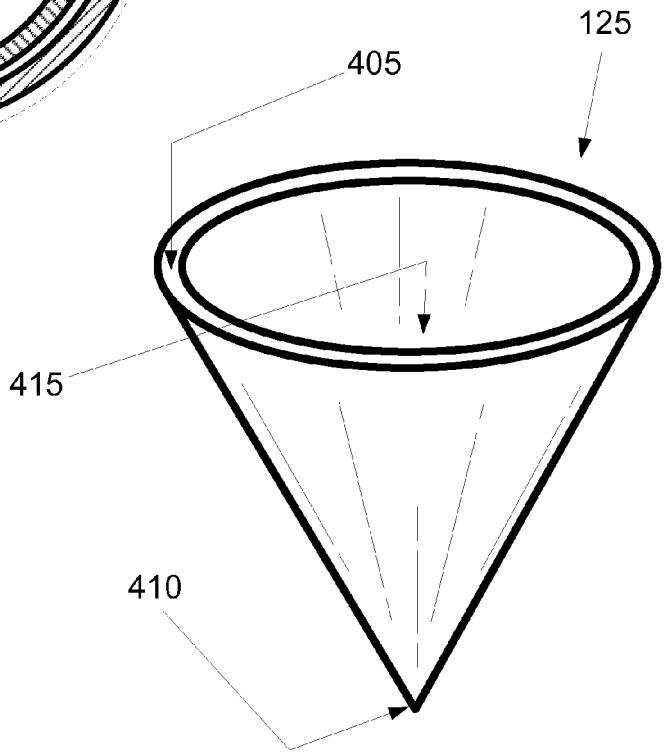
FIG. 4 is a perspective view of the head section showing its conical shape.

The metallic cylindrical casing (110) has an inner diameter (215) and an outer diameter (220). It is the outer diameter (220) that defines an outer circumference (310) of the metallic cylindrical casing (110) shown in approximate position by the dotted circular double arrow in FIG. 3 meant to convey the outer circumference (310) determined by the usual formula of Pi times the outer diameter.

Figure 5:
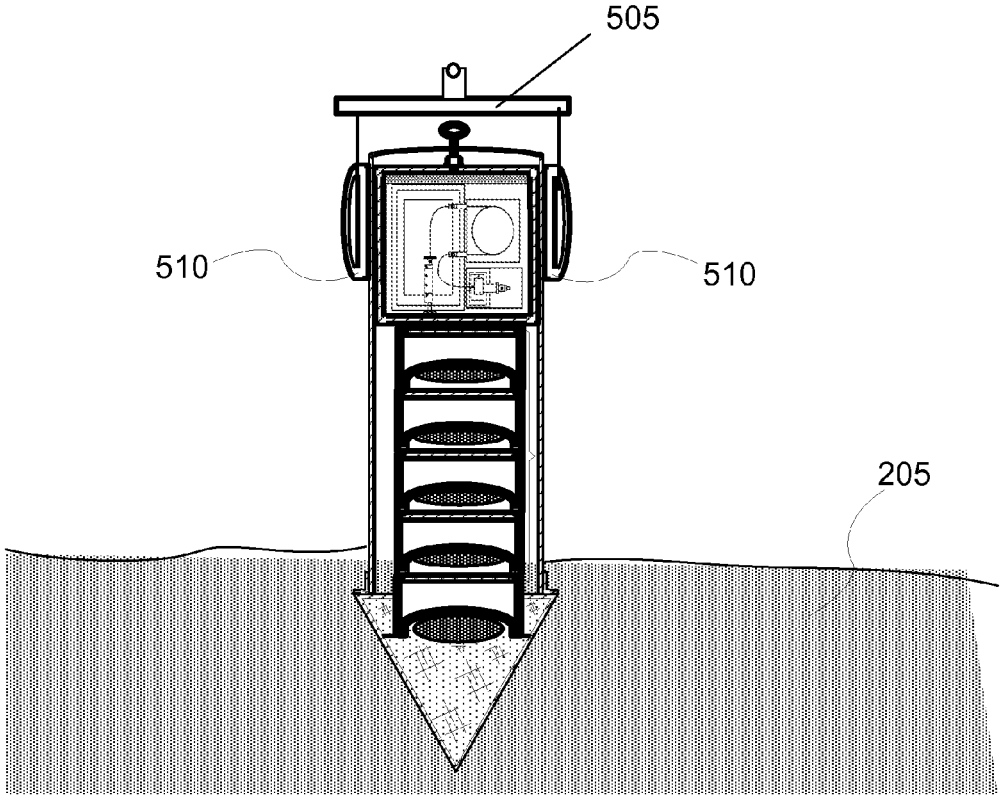
FIG. 5 is a sectional elevation view of an embodiment of the exploratory shaft-making apparatus that dropped for deployment using aerial rigging.

The head section (125) has a conical shape, approximately illustrated in FIG. 5. It is also known as a drive point. The conical shape is defined by a flat base (405) and an apex (410). The flat base (405) is not so much a surface but rather is the end of the head section (125) that is opposite the apex (410) or pointed end. The flat base (405) is the end of the head section (125) that is attached to the bottom end (115) of the metallic cylindrical casing (110).

The flat base (405) of the head section (125) is larger in diameter than the bottom end (115) of the metallic cylindrical casing (110) so that the initial hole made upon first entry of the metallic cylindrical casing (110) into the ground, or geologic formation (205), creates a hole that is larger than the outer diameter (220) of the metallic cylindrical casing (110). The flat base (405), thus, extends beyond the outer diameter (220) of the metallic cylindrical casing (110) around the outer circumference (310) of the metallic cylindrical casing (110). The head section (125) in preferably embodiments may be thought of as a hollow cone because the head section (125) defines an internal chamber (415). The head section (125) is made of a material like hard plastic, or polymer, that will fracture upon detonation of the bottom-most shaped charge (145).

The payload body (305) slidably fits within the metallic cylindrical casing (110). This structural feature permits the payload body (305) to slide down and out of the metallic cylindrical casing (110) as the vertical hole is extended downward by the sequential detonation of the plurality of shaped charges (130). Gravity provides the motive force for the movement of the payload body (305) into the vertical hole (210). The payload body (305) holds and conveys the instrument (180) or payload (105) desired to be used at depth within the geological formation (205).

Figure 2:
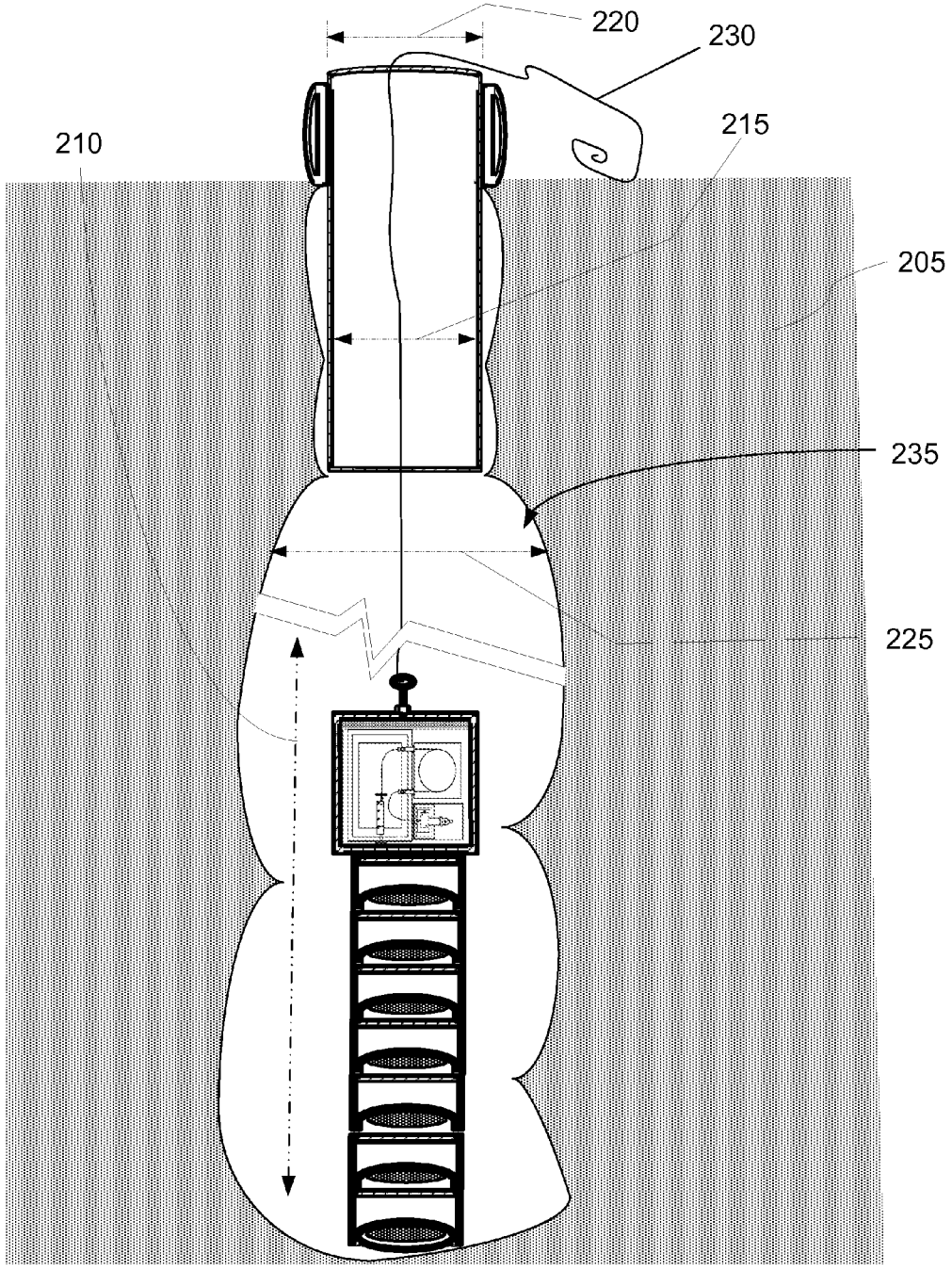
FIG. 2 is a sectional elevation view of the payload body gravity feed at the bottom of a vertical hole where the metallic cylindrical casing remains near the surface.

Each shaped charge in the plurality of shaped charges (130) of high explosive is stacked within the metallic cylindrical casing (110). Stacking of the plurality of shaped charges (130) may be provided by any suitable means. Preferably, each shaped charge is constrained within a housing (165), which has a shape that further defines the desired hole-creating effect of detonation. The housing (165) for each shaped charge preferably has a snap port (170) and a snap projection (175) to removably attach each housing (165) to its neighbor housing holding another shaped charge in a vertical stack. Exemplary positioning of the snap ports and snap projections is shown in an exploded view in FIG. 1. When snapped together they form a vertical stack, as shown in FIG. 2. Thus, the housing (165) acts to separate each shaped charge from an adjacent shaped charge, and snap together with a similarly configured housing (165) by joining the snap projection (175) on one housing (165) with the snap port (170) on another housing (165).

The plurality of shaped charges (130) includes a top-most shaped charge (135) situated below the payload body (305), intermediary shaped charges (140) situated below the top-most shaped charge (135), and a bottom-most shaped charge (145) situated below the intermediary shaped charges (140) and within the internal chamber (415) of the head section (125). The bottom-most shaped charge (145) is used to destroy the head section (125) as well as create a void (235) below the metallic cylindrical casing (110).

The plurality of shaped charges (130) is configured so that after the bottom-most shaped charge (145) is detonated, the shaped charges above the detonated shaped charge slide downward so that the next shaped charge to detonate is positioned below the bottom end (115) of the metallic cylindrical casing (110). Each shaped charge in the plurality of shaped charges (130) is configured upon detonation to create a void (235) in the geological formation (205) below said shaped charge, the void (235) having a void diameter (225) that is wider than the inner diameter (215) of the metallic cylindrical casing (110).

The plurality of shaped charges (130) is adapted to sequentially detonate starting with the bottom-most shaped charge (145) and ending with the top-most shaped charge (135). The detonation sequence may be controlled by a central processing unit (185) that initiates a programmed sequence of instructions that is stored on the non-transitory computer memory (190). Alternatively, each shaped charge in the plurality of shaped charges (130) has its own timer that is set to activate so that the desired sequential detonation occurs.

Thus, in an alternative embodiment, the exploratory shaft-making apparatus (100) may include an instrument (180) located within the payload body (305); a central processing unit (185) within the payload body (305); the central processing unit (185) adapted to control the operation of the instrument (180) and trigger the detonation of each shaped charge according to a program of instructions; non-transitory computer memory (190) connected to the central processing unit (185); the non-transitory computer memory (190) storing the program instructions and data received from the instrument (180); and a radio-frequency transmitter (195) adapted to send the data to the surface.

The exploratory shaft-making apparatus (100) may include shock absorbing material (150) within the internal chamber (415) and between the bottom-most shaped charge (145) and the apex (410) of the head section (125). The shock absorbing material helps to cushion the bottom-most shaped charge (145) from shipping impacts and any shock due to first entry of the head section (125) into the geological formation (205). An example of a shock absorbing material (150) is STYROFOAM.

The exploratory shaft-making apparatus (100) may include a removable cap (155) attached to a side of the payload body (305) nearest the top end (120) of the metallic cylindrical casing (110). A screw-in cap is shown in FIG. 1. The removable cap (155) permits access to the payload body (305) and the plurality of shaped charges (130), as may be desired.

The exploratory shaft-making apparatus (100) may include a fitting (160) attached to the payload body (305). The fitting (160) is configured to enable lifting the payload body (305). For example, once the instrument (180) has performed its function within the geological formation (205), a rope (230) may be used to raise the payload body (305) to the surface for possible reuse or for access to data collected by the instrument (180).

Example 1

In one embodiment, an oil exploration instrument is fitted into the payload body in the metallic cylindrical casing. A stack of shaped charges is loaded below the payload body. A breakaway plastic nose cone is screwed onto the end of the casing to close up the bottom of the metallic cylindrical casing. The metallic cylindrical casing has grip handles on the side so a farmer can lift up the casing and thrust the casing and nose cone into the ground to reach a vertical starting position. When the first shaped charge module within the plastic nose at the bottom of the casing goes off, it explodes apart the plastic-like nose cone and makes a hole in the ground so that the payload body with the oil exploration instrument now has room to start sliding downward and out of the casing.

Each subsequent shaped charge that detonates causes a void below the shaped charge and allows gravity to drop the shaped charge stack lower along with the payload body and oil exploration instrument lower and lower into the ground. When all desired shaped charge modules have gone off and oil exploration probe is at the desired depth, the oil exploration instrument is activated. The oil exploration probe payload has a small battery-operated RF transmitter that sends a signal back up the hole to tell the farmer if any oil was detected. The top of the payload capsule also has a hook so a rope can be tied to the payload body so the farmer can pull it back up from the hole to use it again for another test hole.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the well digging industry.

What is claimed is:

1. An exploratory shaft-making apparatus adapted to create a vertical hole down into a geological formation while sending a payload into the vertical hole, the exploratory shaft-making apparatus comprising:

a metallic cylindrical casing comprising a bottom end and a top end and having an inner diameter and an outer diameter, the outer diameter defining an outer circumference;

a head section comprising a conical shape, the conical shape defined by a flat base and an apex and having a solid inwardly tapered outer surface extending between the flat base and the apex, the flat base attached to the bottom end of the metallic cylindrical casing so that the flat base extends beyond the outer diameter of the metallic casing around the outer circumference of the metallic cylindrical casing, the head section defining an internal chamber;

a payload body slidably movable within the metallic cylindrical casing; and a plurality of shaped charges of high explosive, wherein each shaped charge in the plurality of shaped charges is stacked within the metallic cylindrical casing;

the plurality of shaped charges comprising:

a top-most shaped charge situated below the payload body, intermediary shaped charges below the top-most shaped charge, and a bottom-most shaped charge situated below the intermediary shaped charges and within the internal chamber of the head section;

the plurality of shaped charges is adapted to sequentially detonate starting with the bottom-most shaped charge and ending with the top-most shaped charge;

the plurality of shaped charges is configured so that after the bottom-most shaped charge is detonated, the shaped charges above the bottom-most shaped charge then slide downward so that the next shaped charge to detonate is positioned below the bottom end of the metallic cylindrical casing; and each shaped charge in the plurality of shaped charges is configured upon detonation to create a void in the geological formation below said shaped charge, the void having a void diameter that is wider than the inner diameter of the metallic cylindrical casing.

2. The exploratory shaft-making apparatus of claim 1, further comprising a shock absorbing material within the internal chamber and between the bottom-most shaped charge and the apex of the head section.

3. The exploratory shaft-making apparatus of claim 1, further comprising a removable cap attached to a side of the payload body nearest the top end of the metallic cylindrical casing.

4. The exploratory shaft-making apparatus of claim 1, further comprising a fitting attached to the payload body, the fitting configured to enable lifting the payload body.

5. The exploratory shaft-making apparatus of claim 1, further comprising a housing for each of the plurality of shaped charges, each of the housings comprising a snap port and a snap projection, each of the housings adapted to:

hold one of the plurality of shaped charges, separate one of the plurality of shaped charges from an adjacent one of the plurality of shaped charges, and snap together with an adjacent housing by joining the snap projection on one housing with the snap port on the adjacent housing.

6. The exploratory shaft-making apparatus of claim 1, further comprising:

an instrument located within the payload body;

a central processing unit within the payload body, the central processing unit adapted to control operation of the instrument and trigger the detonation of each shaped charge according to a program of instructions;

non-transitory computer memory connected to the central processing unit, the non-transitory computer memory storing the program instructions and data received from the instrument; and a radio-frequency transmitter adapted to send the data up the vertical hole.

* * * * *